US009903637B1

(12) United States Patent
Dubina et al.

(10) Patent No.: US 9,903,637 B1
(45) Date of Patent: Feb. 27, 2018

(54) CONTAINER SYSTEM FOR A CABINET

(71) Applicant: Electrolux Home Products, Inc., Charlotte, NC (US)

(72) Inventors: Paul Dubina, Anderson, SC (US); Thomas McMahan, Honea Path, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/460,346

(22) Filed: Mar. 16, 2017

(51) Int. Cl.

| | |
|---|---|
| ***F25D 23/00*** | (2006.01) |
| ***F25D 23/02*** | (2006.01) |
| ***F25D 25/02*** | (2006.01) |
| ***F25D 11/02*** | (2006.01) |

(52) U.S. Cl.
CPC ..... *F25D 23/021* (2013.01); *F25D 11/02* (2013.01); *F25D 23/028* (2013.01); *F25D 25/022* (2013.01)

(58) Field of Classification Search
CPC ..... F25D 23/02; F25D 23/021; F25D 23/028; F25D 2323/02
See application file for complete search history.

(56) References Cited

U.S. PATENT DOCUMENTS

| | | | | |
|---|---|---|---|---|
| 3,345,227 | A | 10/1967 | Fraser | |
| 7,866,772 | B1 | 1/2011 | Chen | |
| 8,052,235 | B2 * | 11/2011 | Kelly | F25D 17/042 292/201 |
| 8,702,185 | B2 | 4/2014 | Chellappan et al. | |
| 9,523,530 | B2 * | 12/2016 | Dubina | F25D 25/025 |
| 2012/0262044 | A1 * | 10/2012 | Vulava | F25D 23/021 312/404 |
| 2013/0127323 | A1 | 5/2013 | Seo et al. | |
| 2013/0300275 | A1 * | 11/2013 | Chellappan | F25D 25/025 312/402 |
| 2014/0265808 | A1 | 9/2014 | Kendall et al. | |
| 2015/0253060 | A1 * | 9/2015 | Borise | F25D 23/021 312/405 |

* cited by examiner

*Primary Examiner* — Daniel J Rohrhoff
(74) *Attorney, Agent, or Firm* — Pearne & Gordon LLP

(57) ABSTRACT

A refrigerator includes a cabinet defining an enclosure. The enclosure is bounded by a lower surface, a pair of opposing side surfaces and an upper surface. The apparatus further includes a door for providing selective access to the enclosure that is slidable relative to the cabinet between an open and a closed position, the door being slidably coupled to the cabinet by a slide assembly located externally of the enclosure.

20 Claims, 7 Drawing Sheets

CONTAINER SYSTEM FOR A CABINET

FIELD OF THE INVENTION

The invention relates to a container system for a cabinet and, in particular, to a container system for a refrigerator cabinet.

BACKGROUND

Refrigerator appliances can comprise a cabinet having an upper, fresh-food compartment with one or two vertically hinged doors and a lower, freezer compartment with a drawer-like door that slides open. To slidably couple the lower door to the cabinet, slide assemblies may be used that are mounted to interior side surfaces of the lower compartment. These slide assemblies can also be used to support a basket within the lower compartment and permit the basket to be slid in and out of the lower compartment.

Due to the combined weight of the lower door and basket and the tight tolerances for mounting the door to the cabinet, the slide assemblies coupling the door and basket to the cabinet typically need to be very robust. Moreover, the location of the slide assemblies within a freezer environment requires the use of expensive components that can tolerate and function properly in low temperatures. Thus, slide assemblies that are mounted within a freezer compartment to slidably couple a basket and door can be expensive. Moreover, when slide assemblies are mounted to interior side surfaces of a freezer compartment, the available space for a basket within the compartment is limited in a lateral dimension because the basket cannot extend completely from one side surface of the compartment to the other due to the presence of the slide assemblies.

SUMMARY OF THE INVENTION

In one aspect, a refrigerator comprises a cabinet defining an enclosure. The enclosure is bounded by a lower surface, a pair of opposing side surfaces and an upper surface. The refrigerator further comprises a door for providing selective access to the enclosure that is slidable relative to the cabinet between an open and a closed position, the door being slidably coupled to the cabinet by a slide assembly located externally of the enclosure.

In one example of the aspect, the refrigerator further comprises a container and a rail assembly slidably coupling the container to the cabinet so that the container can be slidably moved between a first position within the enclosure and a second position at least partially outside of the enclosure. The rail assembly is provided below the container.

In one example of the aspect, the rail assembly is coupled to the lower surface of the enclosure.

In another example of the aspect, the rail assembly comprises at least one linear guide member and at least one carriage member slidably coupled to the linear guide member. In one example, the container is fixedly coupled to the at least one carriage member. In another example, the container is fixedly coupled to the at least one carriage member such that a top surface of the at least one carriage member faces a bottom surface of the container. In yet another example, the at least one linear guide member comprises a substantially "I" shaped cross-section defining first and second linear guide channels. In still yet another example, the at least one carriage member comprises a substantially "C" shaped cross-section having a first horizontal portion that rests over the at least one linear guide member and two leg portions that extend downward from the first horizontal portion and straddle the at least one linear guide member. In another example, the rail assembly further comprises at least one bearing configured to facilitate sliding of the at least one carriage member along the at least one linear guide member. In yet another example, the at least one bearing comprises a first roller bearing provided within the first linear guide channel and a second roller bearing provided within the second linear guide channel.

In yet another example of the aspect, the rail assembly comprises a first linear guide member and a second linear guide member that is slidably coupled to the first linear guide member such that the second linear guide member can telescope in and out of the first linear guide member in a linear motion. In one example, the rail assembly is coupled to the door such that sliding of the door between the open and closed position causes the second linear guide member to telescope in or out of the first linear guide member.

In still yet another example of the aspect, the slide assembly comprises a support tube horizontally slidable through a linear bearing. In one example, the slide assembly further comprises a vertically oriented stanchion that is coupled to the support tube and received in the door. In another example, the door can be removed from the slide assembly by sliding the door vertically off of the stanchion. In yet another example, the stanchion is tapered and received in a complementary-shaped receiving cavity in the door. In still yet another example, the stanchion is removably coupled to the support tube. In another example, the stanchion comprises a sleeve portion that receives the support tube and is removably coupled to the support tube by a pin that is inserted through holes in the sleeve portion and support tube. In yet another example, the stanchion comprises a height that is at least ⅕ the height of the door. In still yet another example, the linear bearing is disposed in a support block coupled to a bottom portion of the cabinet below the enclosure. In another example, a roller support is rotatably coupled to the support block.

BRIEF DESCRIPTION OF THE DRAWINGS

Embodiments of the invention are better understood when the following detailed description is read with reference to the accompanying drawings, in which.

DETAILED DESCRIPTION

Figure 1:
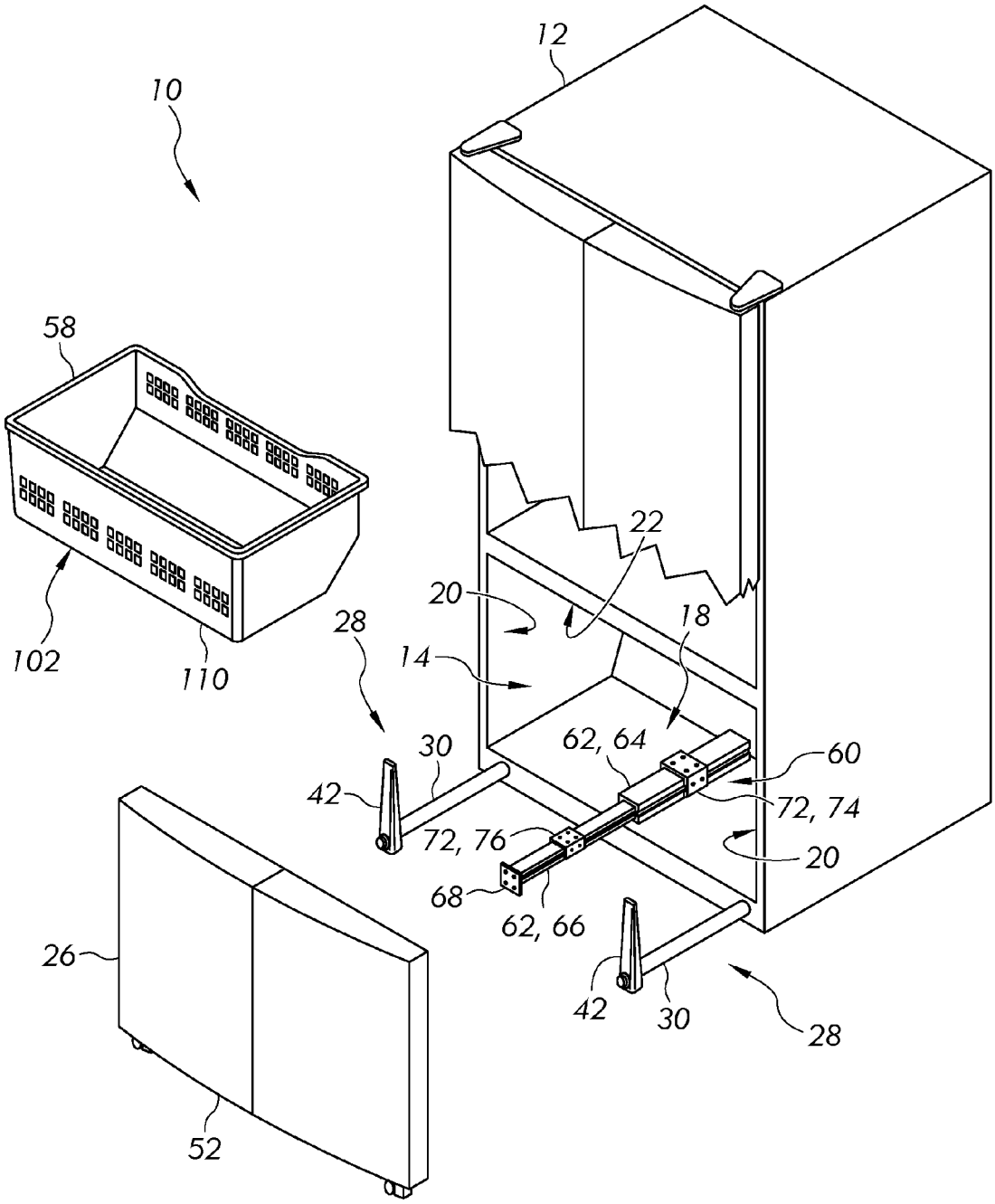
FIG. 1 is an exploded view of an example refrigerator, with French doors of the refrigerator partially broken away to show interior details.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is to be noted that the term "coupled" as used herein when describing two or more features means that the features can be integral with each other or that the features can be separate features that are removably or non-removably attached to each other using various means such as threads, fasteners, hooks, clips, adhesive, welds, or other means of attaching two separate features. Moreover, the features can be coupled such that the features are fixed relative to each other or such that the features can move relative to each other such as, for example, by sliding.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, an example apparatus 10 is shown comprising a cabinet 12 defining an enclosure 14. The apparatus 10 is an appliance and, more specifically, a refrigerator having a fresh-food compartment with French doors and a bottom-mounted freezer compartment, the enclosure 14 being the freezer compartment. However, in some embodiments, the apparatus 10 can be a refrigerator with an alternative arrangement of compartments or a refrigerator with a single compartment. The apparatus 10 can be any cabinet-like structure that comprises a cabinet defining an enclosure and may be characterized as a drawer, a desk, a container, a chest, a safe, a cupboard, a cabinet or the like. The enclosure 14 of the cabinet 12 may provide a particular type of environment for items stored therein and, for example, may be suitable for refrigeration, heating, sanitization, a vacuum, etc.

The enclosure 14 is bound by a lower surface 18, a pair of opposing, interior side surfaces 20, and an upper surface 22. The apparatus 10 can comprise a door 26 that can be slidably coupled to the cabinet 12 for providing selective access to the enclosure 14. For example, the door 26 can be slidably coupled to the cabinet 12 using one or more slide assemblies located externally of the enclosure 14 such as, for example, the pair of slide assemblies 28 shown in FIG. 1. The door 26 can be slidable between a closed position that prevents access to the enclosure 14 and an open position that permits access to the enclosure 14.

Figure 2:
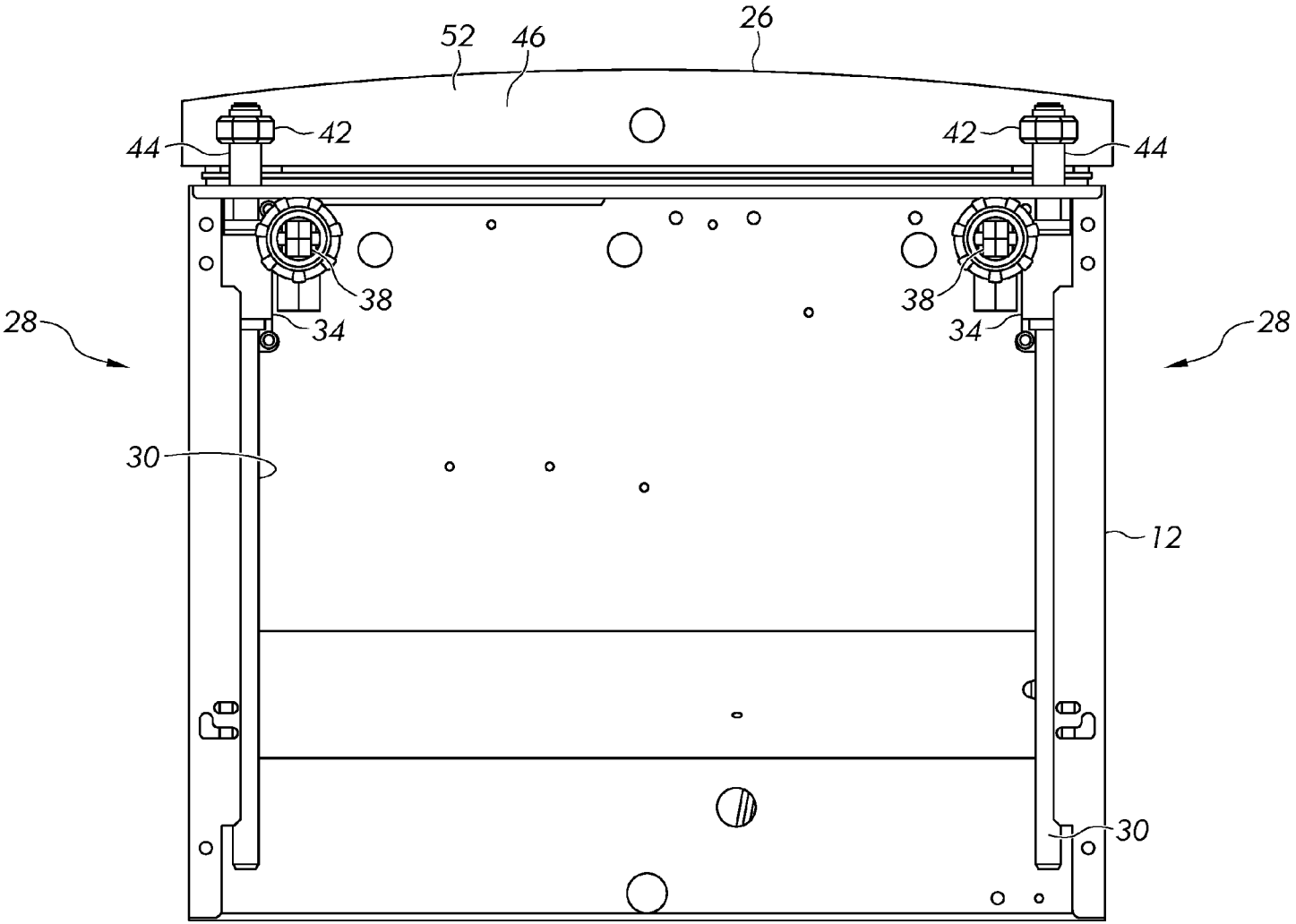
FIG. 2 is a bottom view of the refrigerator.
Figure 3:
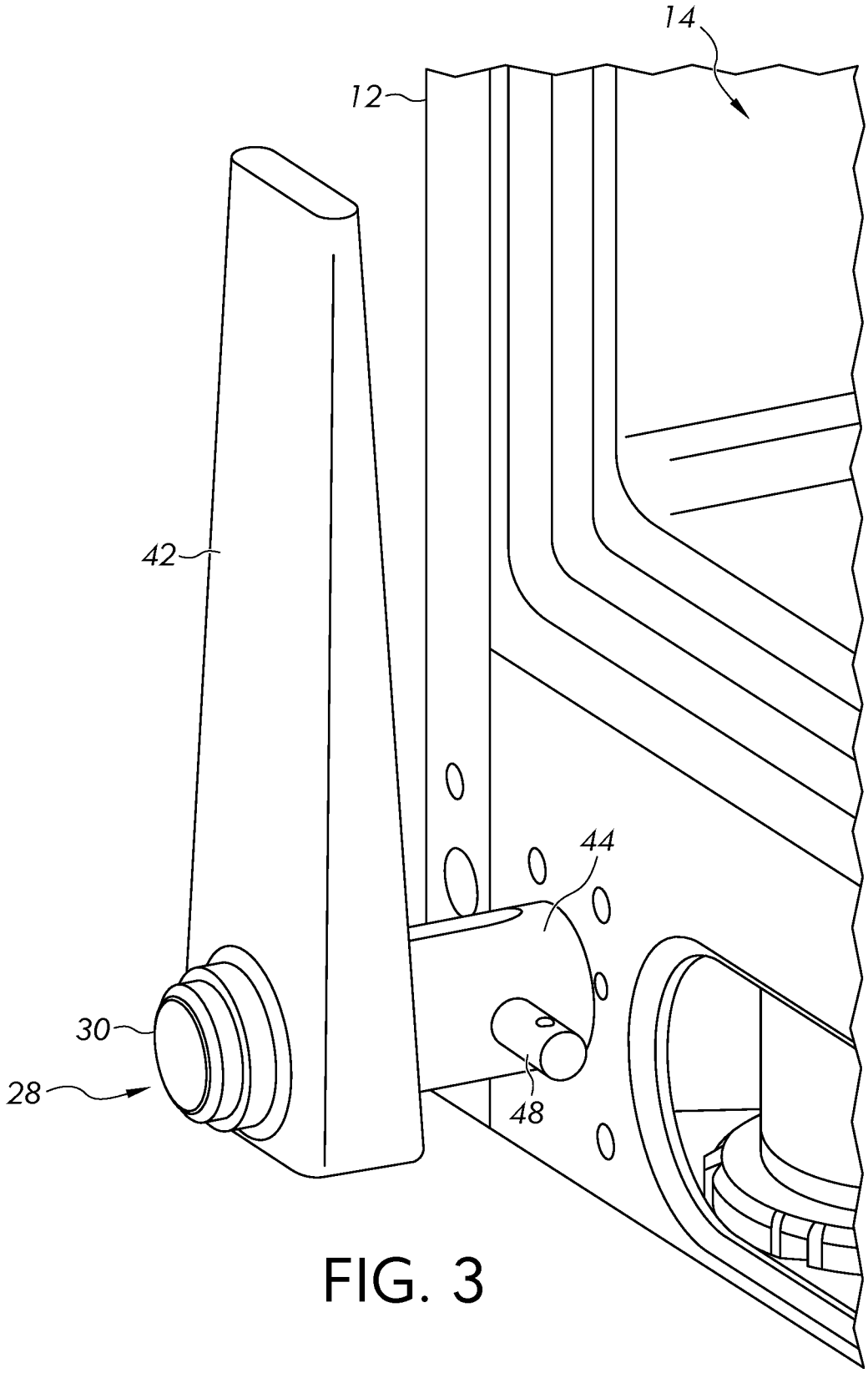
FIG. 3 is a partial isometric view of a slide assembly on a left side of the refrigerator.
Figure 4:
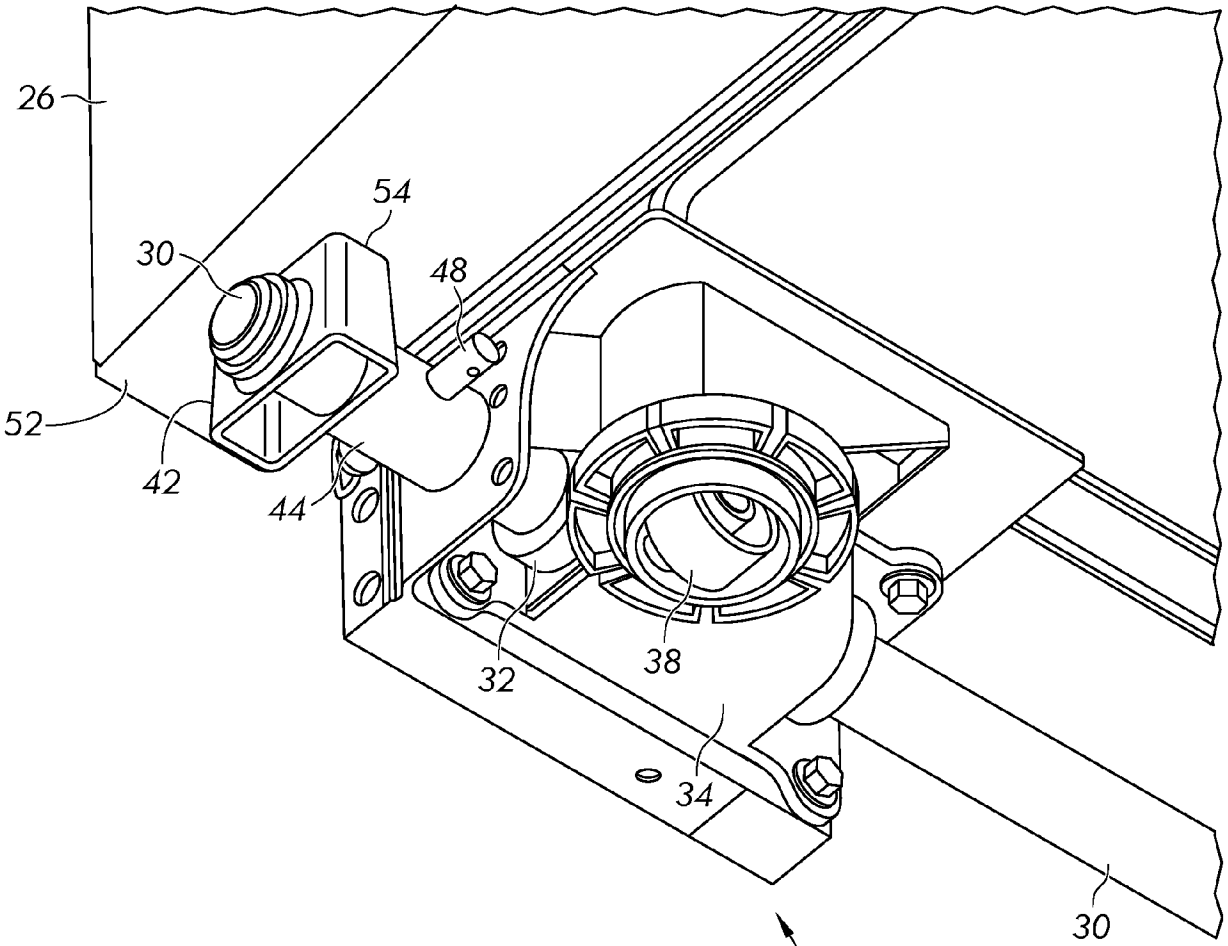
FIG. 4 is an isometric view of the bottom left front of the refrigerator.

As shown in FIGS. 2-4, the slide assemblies 28 can each comprise a support tube 30 that is slidable through a linear bearing 32. The support tube 30 is preferably formed of steel and can have a length approaching the front-to-back depth of the apparatus 10, though other materials and lengths are possible. The support tube 30 can be a longitudinal member having a circular cross-section across its longitudinal axis, as in the illustrated embodiment, or the support tube 30 can have a cross-section of a different shape. Ideally, the bearing 32 is of the recirculating ball-type of known construction, though other bearing types are possible.

The support tube 30 and bearing 32 of each slide assembly 28 are preferably arranged such that the support tube 30 extends and slides horizontally through the bearing 32 in a front-to-back motion and vice versa. The linear bearing 32 can be disposed in a support block 34 that is coupled to a bottom portion of the cabinet 12 underneath the enclosure 14. The support block 34 may be a metal die casting that is bolted or otherwise coupled to the cabinet 12. Also disposed in the support block 34 may be a molded plastic roller support 38 that is rotatably coupled to the support block 34. It will be understood that the weight of the cabinet 12 and its contents is largely transferred to the roller support 38 through the support block 34.

Each slide assembly 28 can further comprises a stanchion 42 that is coupled to a front end of its support tube 30 to provide support for the door 26. In the illustrated case, the stanchions 42 are hollow sheet metal weldments having a wedge shape that extends vertically. More specifically, each side of the stanchions 42 has a profile of a truncated isosceles triangle, though other shapes are possible. Each stanchion 42 can include a sleeve portion 44 at a lower end thereof that is proportioned to receive its associated support tube 30 with a slip fit. Each stanchion 42 can be removably coupled to its respective support tube 30 by sliding its sleeve portion 44 over the support tube 30 and inserting a hitch pin 48 through aligned holes in the sleeve portion 44 and tube 30.

Figure 5:
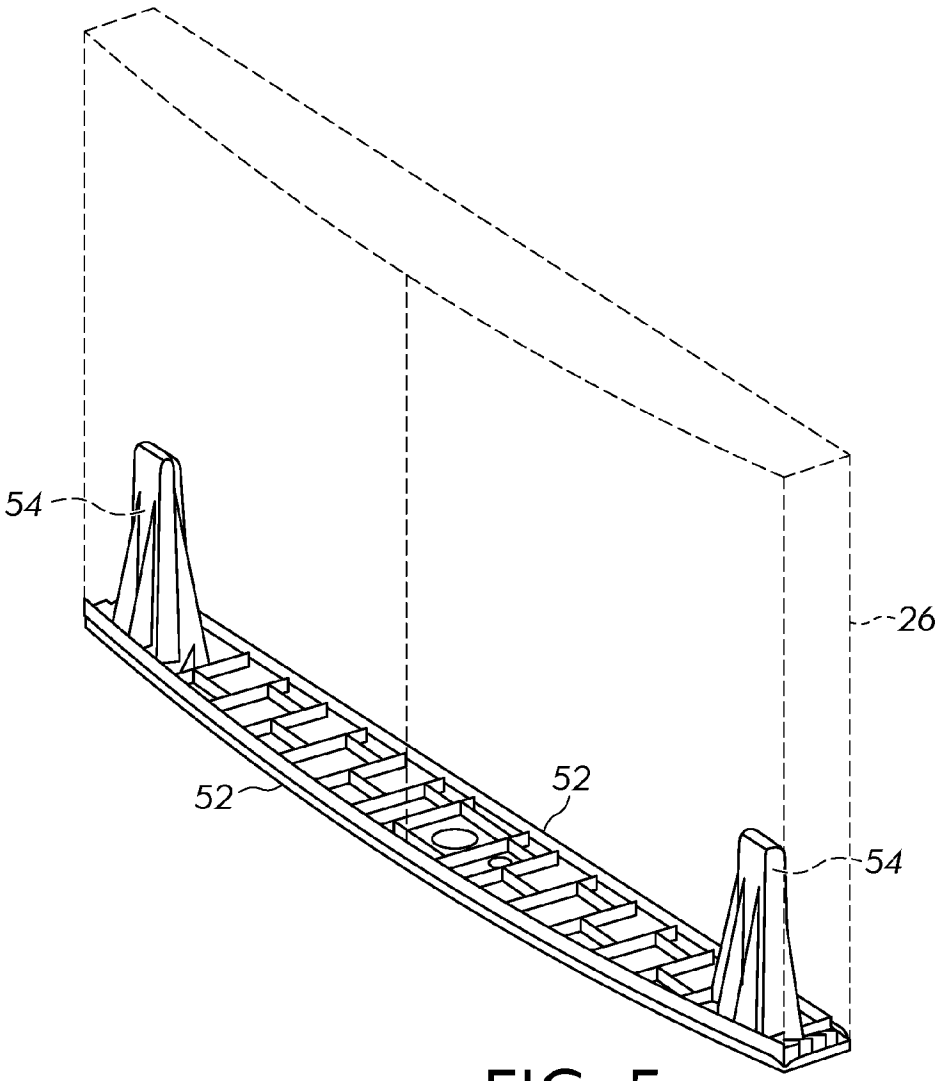
FIG. 5 is a isometric view of a door of the refrigerator.

In order to couple the door 26 to the slide assemblies 28, a bottom wall 52 of the door 26 can be molded or otherwise provided with surface structure in the form of female cavities 54 that can each have a shape complementary to the shape of the stanchions 42 to fit tightly over a respective one of the stanchions 42, as shown in FIG. 5. The complementary taper geometry of the stanchions 42 received in the door 26 and receiving cavities 54 of the bottom wall 52 can assure a friction fit when the door 26 is fully seated on the stanchions 42 to secure the door 26 on the stanchions 42 and minimize or eliminate free play between these elements. The vertical height of the stanchions 42 is preferably a major fraction of the height of the door 26, being, for example, at least ⅕ and preferably ¼ or more of the door height. A spring latch may be provided to further retain the door 26 on the stanchions 42. For example a flexible part of the stanchion 42 can have a detent that engages a slot or hole in the cavity 54 and have a flange accessible from below the door 26 for manual release of the latch.

By using the pair of slide assemblies 28 described above, the door 26 can be easily attached to or removed from the slide assemblies 28 of the cabinet 12 by sliding the door 26 vertically on or off of the stanchions 42 of the slide assemblies 28. Moreover, because the slide assemblies 28 are located externally of the enclosure 14, it is not necessary to manufacture the slide assemblies 28 using expensive components that can tolerate/function in low temperatures which may be present in the enclosure 14. Furthermore, because the slide assemblies 28 are located externally of the enclosure 14, more space is available within the enclosure 14 for items such as containers and/or foodstuff. However, it is to be appreciated that the apparatus 10 can comprise a variety of other structure for slidably coupling the door 26 to the cabinet 12 such as, for example, a single slide assembly or some other structure located externally of the enclosure 14. Moreover, in some examples, the door 26 may be slidably coupled to the cabinet 12 using coupling structure (e.g., one or more slide assemblies) located within the enclosure 14. The door 26 may be slidably coupled to the cabinet 12 using a variety of different structure.

Referring back now to FIG. 1, the apparatus 10 can comprise a container 58 having a box-like shape that is insertable in the enclosure 14 though in some embodiments, the container 58 may have a shape other than that of a box and, for example, may be semi-cylindrical. The container 58 may be a basket formed from multiple parts such as interwoven wires or the container 58 may be formed by molding polymeric material. When inserted in the enclosure 14, the container 58 can make up the entire enclosure 14 or the container 58 can make up a part of the enclosure 14. The container 58 can be accessed directly from the exterior of the cabinet 12 by opening the door 26 or the container 58 may need to be pulled out after the door 26 is first opened.

The container 58 can be slidably coupled to the cabinet 12 so that the container 58 can be slidably moved between a first position (e.g., a retracted position), wherein the container 58 is within the enclosure 14, and a second position (e.g., an extended position), wherein the container 58 is at least partially outside of the enclosure 14. Preferably, the container 58 is slidably coupled so that the container 58 can slide in a horizontal, front-to-back motion and vice versa. For instance, in some examples, the container 58 can be fixed to a rear surface of the door 26 such that the container 58 is cantilevered from and supported by the rear surface. In such examples, the container 58 will move with the door 26 as the door 26 slides between its open and closed positions.

In some examples, the apparatus 10 can comprise at least one rail assembly 60 provided below the container 58 that supports the container 58 from underneath and slidably couples the container 58 to the cabinet 12. The rail assembly 60 can comprise one or more linear guide members 62 that can be slidably or fixedly coupled to the cabinet 12. For example, in the illustrated embodiment, the rail assembly 60 comprises a first linear guide member 64 that is provided within the enclosure 14 and fixedly coupled to the lower surface 18 of the cabinet 12 and a second linear guide member 66 that is slidably coupled to the first linear guide member 64 and cabinet 12. The second linear guide member 66 is configured to telescope in and out of the first linear guide member 64 in a linear motion between a retracted and extended position. In some embodiments, the rail assembly 60 can comprise further linear guide members 62 that telescope within the second linear guide member 66. Moreover, in some embodiments, the rail assembly 60 may comprise just a single linear guide member 62 that is fixed or slidably coupled to the cabinet 12. Furthermore, in some embodiments, the rail assembly 60 may be provided outside of the enclosure 14 and coupled to external cabinet structure.

In some embodiments, the rail assembly 60 can be coupled to the door 26 such that sliding of the door 26 between its open and closed position causes one or more of its linear guide members 62 to translate relative to the cabinet 12. For instance, in the illustrated embodiment, the second linear guide member 66 can be fixedly coupled to the door 26 using a mounting bracket 68 that is coupled to an end of the second linear guide member 66. As such, when the door 26 is slid horizontally between its open and closed positions, the second linear guide member 66 will also translate horizontally relative to the cabinet 12 in a linear motion. In particular, the second linear guide member 66 will telescope in and out of the first linear guide member 64, which is fixed to the bottom surface 18 of the cabinet 12. Thus, the linear guide members 62 can form a track that extends from within the enclosure 14 to the door 26 and can expand or retract as the door 26 is moved between its open and closed positions. However, it is to be noted that there may be embodiments wherein the rail assembly 60 is not coupled to the door 26 and can expand or retract independently of the door's position.

The rail assembly 60 can further comprise one or more carriage members 72 that are slidably coupled to one or more linear guide members 62 of the rail assembly 60. For example, the rail assembly 60 can comprise a first carriage member 74 that is associated with and can slide along the first linear guide member 64. The rail assembly 60 can further comprise a second carriage member 76 that is associated with and can slide along the second linear guide member 66. Alternatively, the rail assembly 60 can comprise a single carriage member 72 that can slide along multiple linear guide members 62 of the rail assembly 60.

Figure 6:
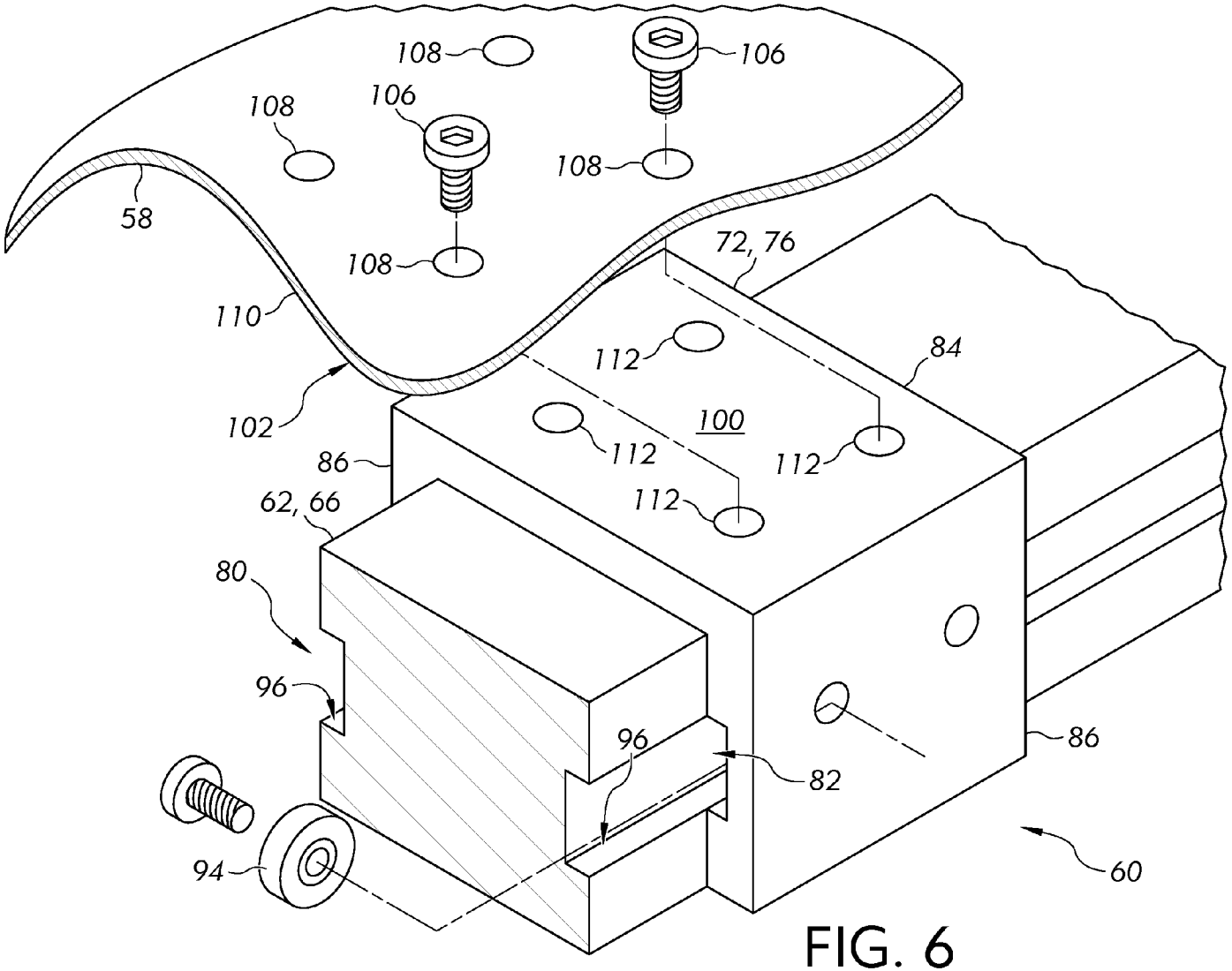
FIG. 6 is a partial isometric exploded view of a rail assembly and container of the refrigerator.
Figure 7:
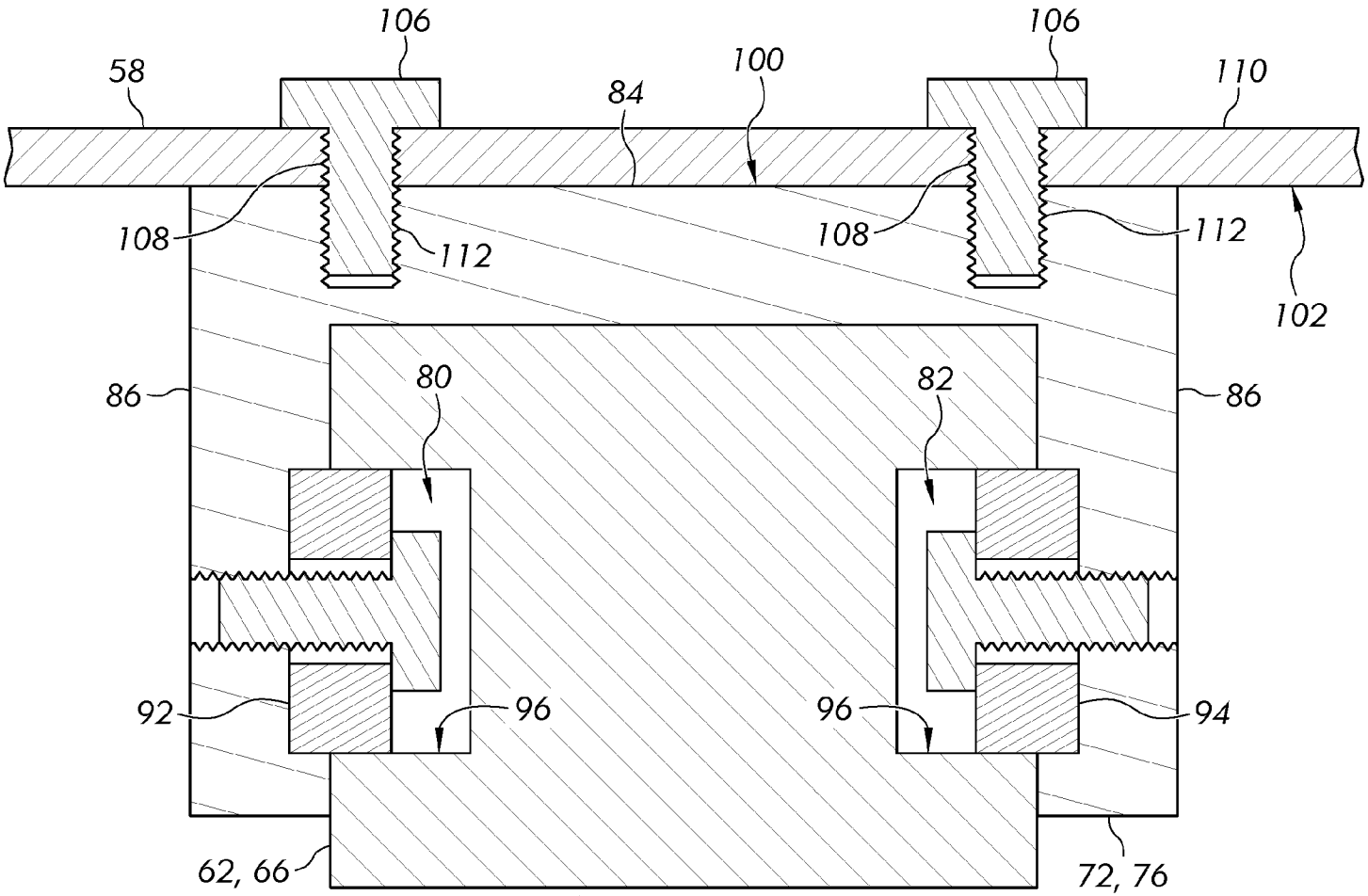
FIG. 7 is a partial cross-sectional view of the rail assembly and container of the refrigerator.

Each linear guide member 62 and associated carriage member 72 of the rail assembly 60 is preferably configured to permit a sliding engagement therebetween. For example, each linear guide member 62 can be a longitudinal member having a substantially "I" shaped cross-section along its longitudinal axis that defines a first linear guide channel 80 and a second linear guide channel 82, as shown in FIGS. 6 & 7. Moreover, each associated carriage member 72 can have a substantially "C" shaped cross-section configured such that the carriage member 72 will rest over the linear guide member 62 with the "C" shaped cross-section opening downward. More specifically, the "C" shaped cross-section can comprise a horizontal portion 84 that extends over the linear guide member 62 and two leg portions 86 that extend downward from the horizontal portion 84 and straddle opposite sides of the linear guide member 62.

In some embodiments, the rail assembly 60 can comprise one or more bearings 90 configured to facilitate sliding of each carriage member 72 along its associated linear guide member 62. For instance, the rail assembly 60 can comprise a first roller bearing 92 and a second roller bearing 94. In some examples, the first and second roller bearings 92, 94 can be rotatably mounted to the leg portions 86 of each carriage member 72 such that the first and second roller bearings 92, 94 are respectively provided within the first and second linear guide channels 80, 82 of its associated linear guide member 62 and will translate through the first and second linear guide channels 80, 90 as the carriage member 72 slides along the linear guide member 62. The first and second roller bearings 92 can rest against a lower surface 96 of the first and second linear guide channels 80, 82, thereby supporting the weight of the carriage member 72 and any structure resting on top of the carriage member 72. The first and second roller bearings 92, 94 can be configured to rotate about a rotational axis that is perpendicular to direction of translation of the carriage member 72 relative to the linear guide member 62 so that when the carriage member 72 is slid along the linear guide member 62, the first and second roller bearings 92, 94 can rotate and facilitate sliding of the carriage member 72 along the linear guide member 62. In other examples, the first and second roller bearings 92, 94 can be rotatably mounted to each linear guide member 62 such that its associated carriage member 72 will translate over the first and second roller bearings 92, 94 as the carriage member 72 slides along the linear guide member 62. The first and second roller bearings 92, 94 can take on a variety of different configurations to help facilitate sliding of the carriage member 72 along the linear guide member 62.

The container 58 can be fixedly coupled to the one or more carriage members 72 of the rail assembly 60 such that the container 58 can be slid relative to the cabinet 12 along the one or more linear guide members 62 of the rail assembly 60 with the carriage members 72. For example, as shown in shown in FIGS. 6 & 7, the container 58 can be fixed to each carriage member 72 such that a top surface 100 of the carriage member 72 faces and abuts a bottom surface 102 of the container 58. The container 58 can be fixed using fasteners 106 that extend through apertures 108 in a bottom wall 110 of the container 58 and are threadably inserted into threaded bores 112 in the horizontal portion 84 of the carriage member 72. However, the container 58 can be fixed to each carriage member 72 using other means or according to other arrangements without departing from the scope of the invention.

Preferably, the container 58 is fixedly coupled to the one or more carriage members 72 such that the rail assembly 60 is provided below the container 58 between the container 58 and the bottom surface 18 of the cabinet 12. When arranged as such, the rail assembly 60, which can be aesthetically displeasing, can be at least partially hidden from view from above the container 58.

Although the apparatus 10 in the illustrated embodiment comprises a single rail assembly 60 slidably coupling the container 58 to the enclosure 14, it is to be appreciated that there may be embodiments that comprise multiple rail assemblies 60. Moreover, although the container 58 is supported from below by the rail assembly 60, there may be other structure provided at the sides of the container 58 to help support the container 58 such as, for example, between the container 58 and the side surfaces 20 of the enclosure 14.

In some examples, the container 58 can be coupled to both the rail assembly 60 and the door 26 to slidably couple the container 58 to the cabinet 12. For instance, the container 58 can be fixed to a rear surface of the door 26 and coupled to the one or more carriage members 72 of the rail assembly 60 as described above. In such examples, the container 58 will slide between its retracted and extended positions as the door 26 is moved between its closed and opened positions. However, it is to be appreciated that the container 58 may not be coupled to the door 26 in some embodiments and may move independently of the door 26.

In the example apparatus 10 described above, because the container 58 is supported by the rail assembly 60 underneath the container 58 and the door 26 is mounted using separate slide assemblies 28 located externally of the enclosure 14, it is not necessary to use mounting structure for the door 26 and/or container 58 that is mounted along the interior side surfaces 20 of the enclosure 14. As such, the container's lateral dimension can be increased and maximized. Moreover, because the rail assembly 60 for the container 58 is not being used to support a weight of the door 26, the rail assembly 60 does not have to be made with expensive components that can withstand low temperatures while supporting the combined weight of the container 58 and door 26. However, it is to be appreciated that in some embodiments, the apparatus 10 may not comprise the external slide assemblies 28 and the container 58 and door 26 may both be slidably coupled to the cabinet 12 using the rail assembly 60. Alternatively, the apparatus 10 may not comprise the rail assembly 60 and the container 58 and door 26 may both be slidably coupled to the cabinet 12 using the external slide assemblies 28. The apparatus 10 can comprise the external slide assemblies 28 and rail assembly 60, either alone or in combination, to slidably couple the container 58 and/or door 26 to the cabinet 12.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A refrigerator comprising:

a cabinet defining an enclosure, the enclosure being bounded by a lower surface, a pair of opposing side surfaces and an upper surface;

a door for providing selective access to the enclosure that is slidable relative to the cabinet between an open and a closed position, the door being slidably coupled to the cabinet by a slide assembly located externally of the enclosure;

a container; and a rail assembly slidably coupling the container to the cabinet so that the container can be slidably moved between a first position within the enclosure and a second position at least partially outside of the enclosure, wherein the rail assembly is provided below the container.

2. The refrigerator of claim 1, wherein the rail assembly is coupled to the lower surface of the enclosure.

3. The refrigerator of claim 1, wherein the rail assembly comprises at least one linear guide member and at least one carriage member slidably coupled to the linear guide member.

4. The refrigerator of claim 3, wherein the container is fixedly coupled to the at least one carriage member.

5. The refrigerator of claim 4, wherein the container is fixedly coupled to the at least one carriage member such that a top surface of the at least one carriage member faces a bottom surface of the container.

6. The refrigerator of claim 3, wherein the at least one linear guide member comprises a substantially "I" shaped cross-section defining first and second linear guide channels.

7. The refrigerator of claim 6, wherein the at least one carriage member comprises a substantially "C" shaped cross-section having a first horizontal portion that rests over the at least one linear guide member and two leg portions that extend downward from the first horizontal portion and straddle the at least one linear guide member.

8. The refrigerator of claim 6, wherein the rail assembly further comprises at least one bearing configured to facilitate sliding of the at least one carriage member along the at least one linear guide member.

9. The refrigerator of claim 8, wherein the at least one bearing comprises a first roller bearing provided within the first linear guide channel and a second roller bearing provided within the second linear guide channel.

10. The refrigerator of claim 1, wherein the rail assembly comprises a first linear guide member and a second linear guide member that is slidably coupled to the first linear guide member such that the second linear guide member can telescope in and out of the first linear guide member in a linear motion.

11. The refrigerator of claim 10, wherein the rail assembly is coupled to the door such that sliding of the door between the open and closed position causes the second linear guide member to telescope in or out of the first linear guide member.

12. The refrigerator of claim 1, wherein the slide assembly comprises a support tube horizontally slidable through a linear bearing.

13. The refrigerator of claim 12, wherein the slide assembly further comprises a vertically oriented stanchion that is coupled to the support tube and received in the door.

14. The refrigerator of claim 13, wherein the door can be removed from the slide assembly by sliding the door vertically off of the stanchion.

15. The refrigerator of claim 13, wherein the stanchion is tapered and received in a complementary-shaped receiving cavity in the door.

16. The refrigerator of claim 13, wherein the stanchion is removably coupled to the support tube.

17. The refrigerator of claim 16, wherein the stanchion comprises a sleeve portion that receives the support tube and is removably coupled to the support tube by a pin that is inserted through holes in the sleeve portion and support tube.

18. The refrigerator of claim 13, wherein the stanchion comprises a height that is at least ⅕ the height of the door.

19. The refrigerator of claim 12, wherein the linear bearing is disposed in a support block coupled to a bottom portion of the cabinet below the enclosure.

20. The refrigerator of claim 19, wherein a roller support is rotatably coupled to the support block.

* * * * *